US005975955A

United States Patent [19]

Bogiel et al.

[11] Patent Number: 5,975,955

[45] Date of Patent: Nov. 2, 1999

[54] SHIELDED ELECTRICAL CONNECTOR ASSEMBLY WITH GROUNDING SYSTEM

[75] Inventors: Steven B. Bogiel, Lisle; Mark M. Data, Bolingbrook, both of Ill.; Robert DeRoss, Palm Harbor, Fla.

[73] Assignee: Molex Incorporated, Lisle, Ill.

[21] Appl. No.: 08/990,649

[22] Filed: Dec. 15, 1997

[51] Int. Cl.[6] ..... H01R 13/648

[52] U.S. Cl. ..... 439/607

[58] Field of Search ..... 439/607, 608, 439/609, 610, 701, 78, 79, 540

[56] References Cited

U.S. PATENT DOCUMENTS 5,059,132 10/1991 Skowronski et al. ..... 439/100
5,387,130 2/1995 Fedder et al. ..... 439/610
5,456,618 10/1995 Nakamura ..... 439/610
5,611,711 3/1997 Okada et al. ..... 439/608

OTHER PUBLICATIONS

A picture of the Relock Connector, first sold on Oct. 1, 1992.

*Primary Examiner*—Lincoln Donovan
*Assistant Examiner*—Eugene G. Byrd
*Attorney, Agent, or Firm*—Stephen Z. Weiss

[57] ABSTRACT

A shielded electrical connector assembly includes a dielectric housing having at least one terminal-receiving passage. An opening is provided in an outside wall of the housing communicating with the passage. A terminal is inserted into the passage, with an engaging portion of the terminal aligned with the opening. A conductive shell is disposed about at least a portion of the housing. The shell includes a finger portion extending through the opening in the housing into engagement with the engaging portion of the terminal.

13 Claims, 3 Drawing Sheets

SHIELDED ELECTRICAL CONNECTOR ASSEMBLY WITH GROUNDING SYSTEM

FIELD OF THE INVENTION

This invention generally relates to the art of electrical connectors and, particularly, to a grounding system for grounding a shell of the connector with a ground terminal of the connector.

BACKGROUND OF THE INVENTION

Generally, a typical electrical connector includes an insulating or dielectric housing having a plurality of terminal-receiving passages. A plurality of conductive terminals are inserted into the passages. The terminals may be terminated to discrete electrical wires, circuit traces on a printed circuit board or other appropriate terminal leads. A mating end of the housing is interengageable with the mating end of a complementary mating connector or other connecting device.

Some electrical connectors include a shield or shell about the connector housing to protect the terminal interface from ingress or egress of electromagnetic interference (EMI) and/or radio frequency interference (RFI). The shield often is a stamped and formed sheet metal shell, and it is desirable to connect the shell to ground. One method of grounding the shell is to attach a ground wire directly to the shell. This method has problems in requiring a separate connecting operation and also is relatively expensive. Another method of grounding the shell is to place a metal bracket around the connector housing, with the bracket being interengaged between the shell and a bare ground wire extending out of the rear of the connector housing. The bracket may include latches for engaging the mating connector. Such brackets also are relatively expensive and require separate connecting operations. In addition, the ground wire must be stripped to expose a bare portion thereof, and the ground wire is not supported to ensure good engagement between the bracket and the wire.

The present invention is directed to solving the grounding problems discussed above in a very simple and very efficient shielded electrical connector assembly wherein the connector shield or shell is grounded to a ground terminal in the connector housing automatically in response to assembling the shell to the housing.

SUMMARY OF THE INVENTION

An object, therefore, of the invention is to provide a new and improved shielded electrical connector assembly of the character described.

In the exemplary embodiment of the invention, the connector assembly includes a dielectric housing having at least one terminal-receiving passage. An opening is provided in an outside wall of the housing communicating with the passage. A terminal is inserted into the housing, with an engaging portion of the terminal aligned with the opening. A conductive shell is disposed about at least a portion of the housing. The shell includes a finger portion extending through the opening in the housing into engagement with the engaging portion of the terminal. Therefore, the shell is grounded to the terminal automatically in response to assembling the shell to the housing.

As disclosed herein, the shell is a multi-part structure including a pair of similar shell halves substantially surrounding the connector housing. One of the shell halves includes a pair of the finger portions for straddling the engaging portion of the terminal. The connector housing is shown herein as having a plurality of the terminal-receiving passages, with one passage being aligned with the opening in the housing for receiving a ground terminal to ground the shell.

The terminal-receiving passage communicating with the opening has opposite ends. In one embodiment of the invention, the opening in the housing is located intermediate the opposite ends of the passage. In another embodiment, the opening in the housing is located near one end of the passage.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
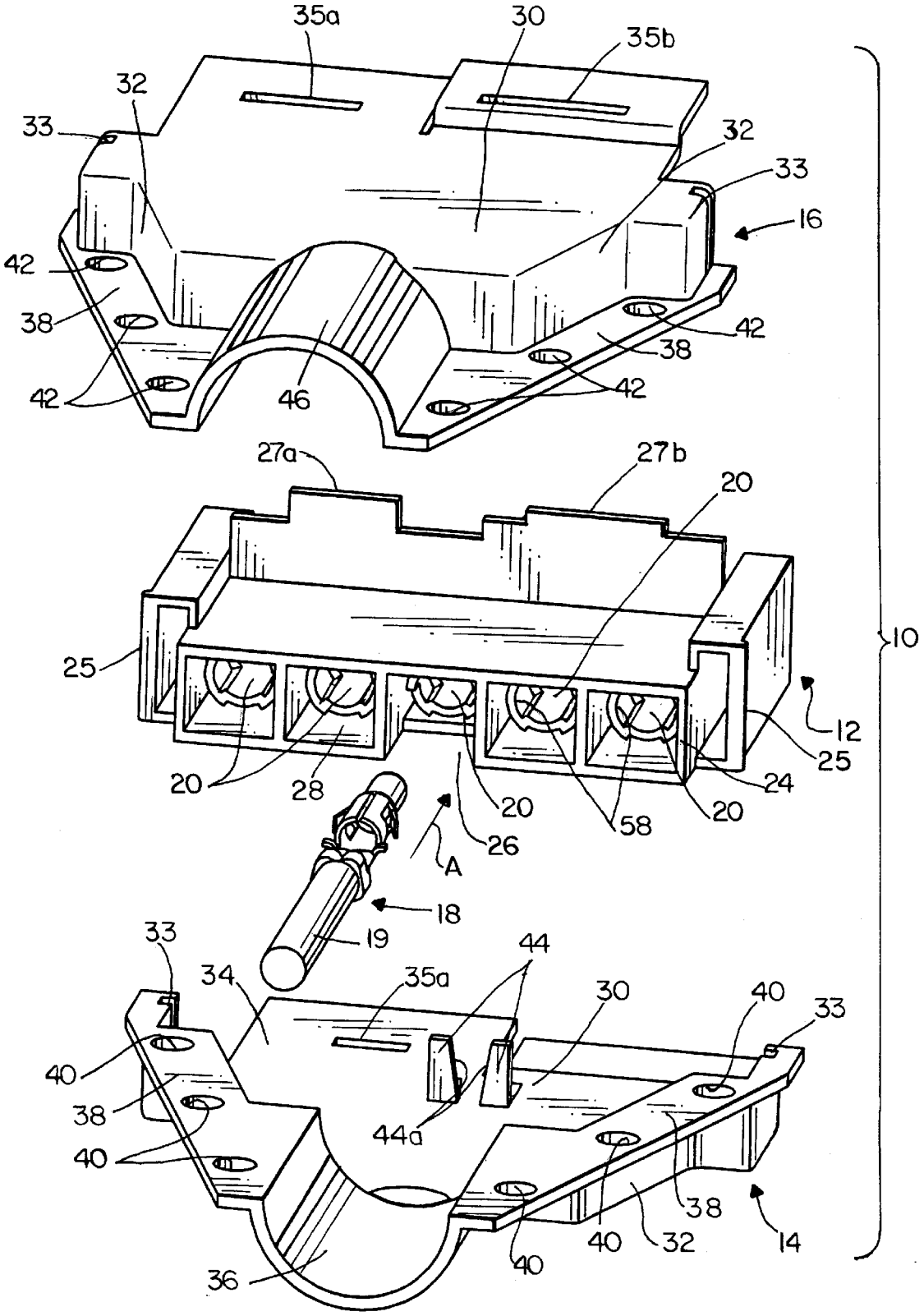
FIG. 1 is an exploded perspective view of one embodiment of a shielded electrical connector assembly incorporating the concepts of the invention.
Figure 2:
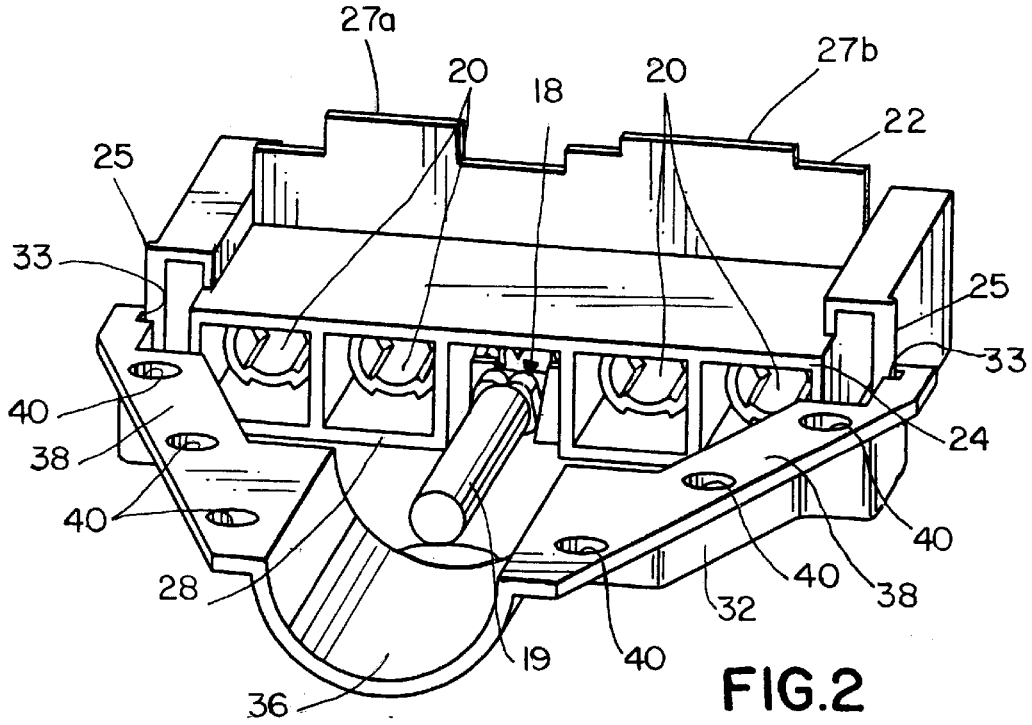
FIG. 2 is a perspective view of the assembly of FIG. 1, in assembled condition without the top shell half to facilitate the illustration.

Referring to the drawings in greater detail, and first to FIGS. 1 and 2, a first embodiment of a shielded electrical connector assembly, generally designated 10, is shown to include a dielectric housing, generally designated 12, substantially surrounded by a shell which includes two interengaging shell halves, namely a lower shell half, generally designated 14, and an upper shell half, generally designated 16. A plurality of female terminals, generally designated 18, are mounted within the housing within the shell. Only one terminal 18 is shown in the drawings.

More particularly, dielectric housing 12 includes a plurality of terminal-receiving passages 20 for receiving the plurality of terminals 18. In the illustrated embodiment, the housing has five passages for receiving five terminals, although only one terminal 18 is shown for insertion into the center passage. The housing has a front mating end 22 which defines the mating interface for connecting the connector assembly to a complementary mating connector assembly or other connecting device. Passages 20 open at a rear terminating face 24 of the housing and into which the terminals are inserted in the direction of arrow "A" (FIG. 1). Vertical locating ribs 25 are located on each side of the housing. Horizontal locating ribs 27*a* and 27*b* extend from the upper and lower surfaces of the housing 12. Finally, housing 12 includes an opening 26 in an outside (bottom ) wall 28 thereof. The opening is in communication with the center terminal-receiving passage 20. Therefore, for purposes of the grounding discussion herein, the one terminal 18 shown in FIGS. 1–3 can be considered a ground terminal which is terminated to a ground wire of an electrical cable having least five wires terminated to connector assembly 10.

Referring to FIG. 1 in conjunction with FIG. 2, lower shell half 14 is a one-piece structure stamped and formed of conductive sheet metal material. The lower shell half includes a base wall 30 and side walls 32 to define a front-opening cavity 34 into which housing 12 is positioned. Vertical locating slots 33 are provided in each side wall 32 being adapted to receive vertical locating ribs 25 of the housing 12. Horizontal locating slots 35*a* and 35*b* are provided in base wall 30 being adapted to receive horizontal locating ribs 27*a* and 27*b* respectively. These complementary slots and ribs help to hold housing 12 within the wall shell 14 and upper shell 16 when the parts are assembled together. An arcuate portion 36 is provided for embracing one side of the electrical cable terminated to the connector assembly. Side flanges 38 have appropriate fastening holes 40 for alignment with fastening holes 42 (FIG. 1) of upper shell half 16 to clamp the shell halves together sandwiching housing 12 therebetween. Finally, lower shell half 14 includes a pair of stamped and formed engaging fingers 44 which are effective for extending through opening 26 in bottom wall 28 of housing 12 and establishing a solid connection with ground terminal 18. It can be seen in FIG. 1 that the opposing inside edges 44*a* of fingers 44 diverge outwardly to define an inwardly tapered mouth for receiving an engaging portion of the terminal.

Upper shell half 16 also is a one-piece structure stamped and formed of conductive sheet metal material similar to the bottom shell half 14. The precise construction of the shell half can vary as long as the shell half appropriately engages lower shell half 14 and sandwiches housing 12 between the shell halves. The upper shell half has an arcuate portion 46 cooperating with arcuate portion 36 of lower shell half 14 to clamp the electrical cable therebetween. In the preferred embodiment, the two shell halves substantially surround housing 12 and the interengaging area of the terminals, such as an interengagement between female terminals 18 and male terminals of the complementary mating connector.

FIG. 2 clearly shows how dielectric housing 12 is assembled or seated within lower shell half 14 with vertical ribs 25 located within vertical slots 33. The terminals 18 typically would have been inserted into passages 20 in the direction "A" prior to assembling the housing to the lower shell half. Electrical wires 19 of the electrical cable (not shown) typically would have been terminated to the terminals and wrapped for extending outwardly of the connector assembly through arcuate portion 36 of the lower shell half. The upper shell half 16 then can be fastened onto the lower shell half to encapsulate housing 12 and the terminated terminals 18 within the shell.

As housing 12 is assembled to lower shell half 14, fingers 44 of the lower shell half move through opening 26 in bottom wall 28 of the housing and into engagement with ground terminal 18. With the tapered edges 44*a* of the fingers, a solid press-fit is established between the bottom shell half and the ground terminal to give a good connection therebetween.

Figure 3:
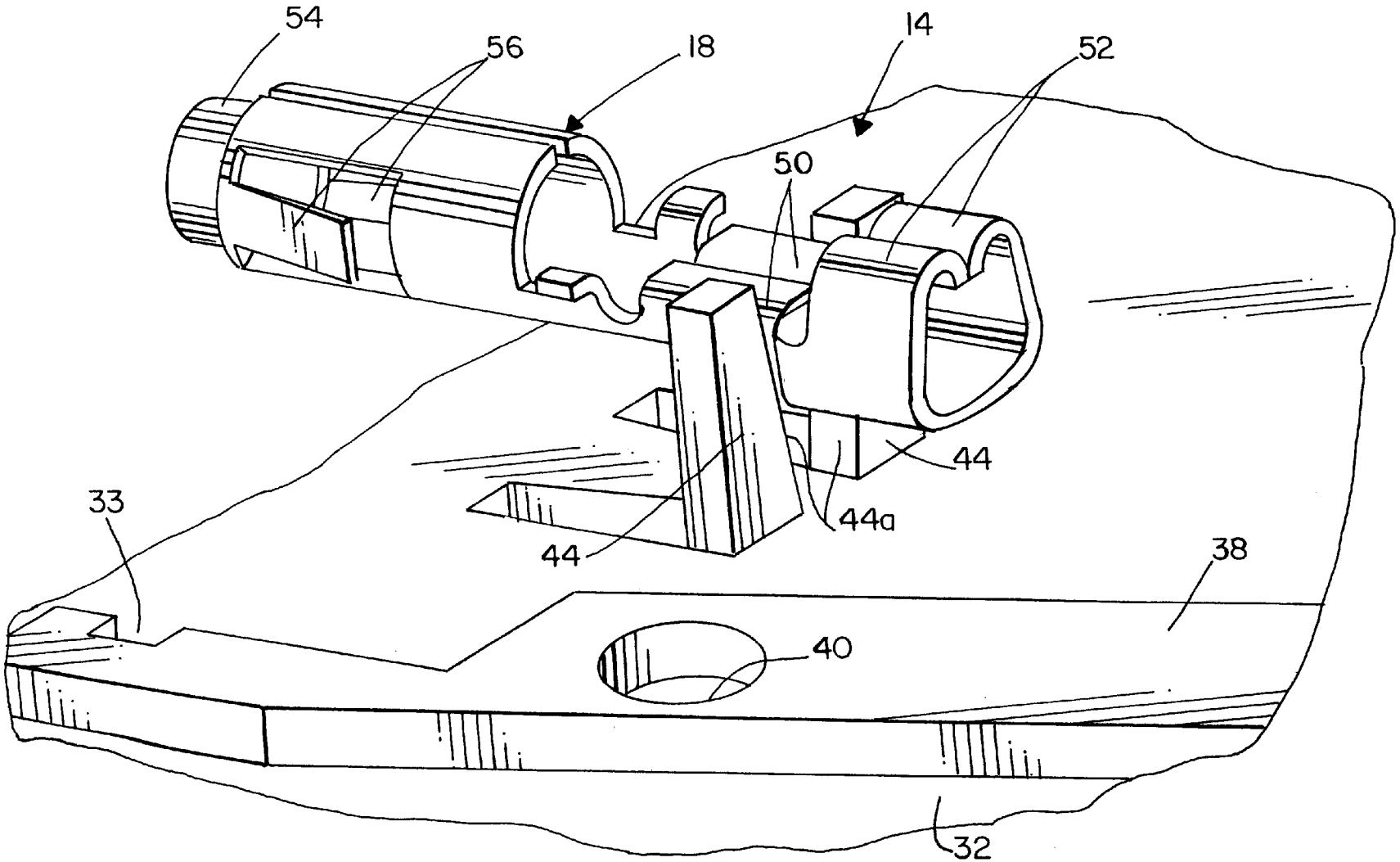
FIG. 3 is a fragmented perspective view showing the interengaging area between the fingers of the shell and the ground terminal.

FIG. 3 shows an isolation of ground terminal 18 relative to bottom shell half 14 and engaging fingers 44. The dielectrical housing 12 is not shown. It can be seen that the two fingers straddle a solid engaging portion of the terminal defined by a pair of inwardly turned crimp arms 50 which have been crimped onto the conductive core of an appropriate electrical wire. A second pair of crimp arms 52 are provided on the terminal for crimping onto the outer insulating cladding of the wire. A front mating end 54 of the terminal is generally hollow to form the terminal as a female terminal for receiving a male terminal of the complementary mating connector. A pair of cantilevered locking arms 56 project from opposite sides of the terminal for locking within latch openings 58 (FIG. 1) within terminal-receiving passages 20 of the housing. Each terminal 18 is stamped and formed of conductive sheet metal material.

Figure 4:
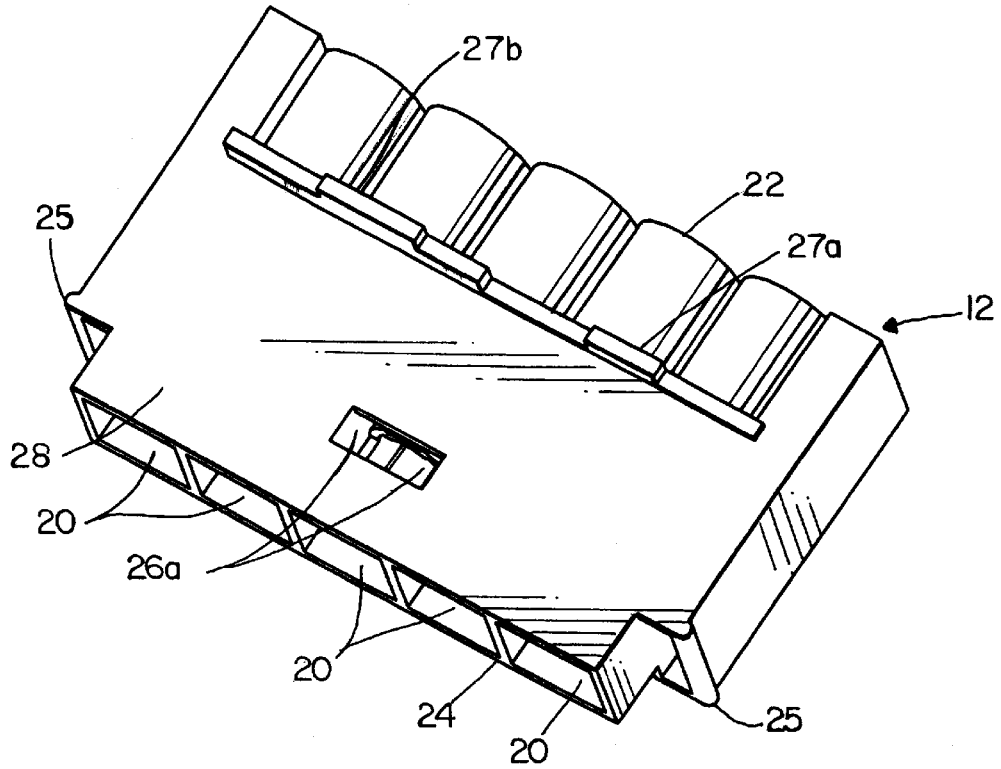
FIG. 4 is a perspective view of the connector housing for mounting the shell half of an alternate embodiment of the invention.

In the embodiment of the connector assembly shown in FIGS. 1–3, engaging fingers 44 of bottom shell half 14 are located for moving into opening 26 in bottom wall 28 of the housing, with the opening located near or at the rear end of the center passage which receives ground terminal 18. In a second embodiment shown in FIG. 4, a bifurcated opening 26*a* is located intermediate the front mating end 22 and the rear terminating end 24 of housing 12. Fingers 44 are located for projecting through bifurcated opening 26*a* when the housing is assembled in the lower shell half. Otherwise, the concepts of the invention are equally applicable to both embodiments, and like reference numerals have been applied in FIG. 4 corresponding to like components described above and shown in FIGS. 1–3.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A shielded electrical connector assembly, comprising:

a dielectric housing having at least one terminal-receiving passage, with an opening in an outside wall of the housing communicating with the passage;

a terminal inserted into the passage, with an engaging portion of the terminal aligned with said opening; and a conductive shell about at least a portion of the housing and including a finger portion formed integrally with the shell extending through the opening in the housing into engagement with the engaging portion of the terminal.

2. The shielded electrical connector assembly of claim 1 wherein said shell substantially surrounds the housing.

3. The shielded electrical connector assembly of claim 1 wherein said shell is a multi-part structure including at least two interengageable parts about said at least a portion of the housing.

4. The shielded electrical connector assembly of claim 3 wherein said two parts of the shell comprise similar shell halves.

5. The shielded electrical connector assembly of claim 1, including a pair of said finger portions of the shell straddling the engaging portion of the terminal.

6. The shielded electrical connector assembly of claim 5 wherein said pair of finger portions have opposing, tapered edges to define a converging mouth for positively gripping the engaging portion of the terminal.

7. The shielded electrical connector assembly of claim 1 wherein said terminal-receiving passage has opposite ends, and the opening in the housing is located near one end of the passage.

8. The shielded electrical connector assembly of claim 1 wherein said housing has a forward mating end and rearward terminating end, and the opening in the housing is located intermediate the ends.

9. The shielded electrical connector assembly of claim 1, including a plurality of said terminal-receiving passages in the housing, one passage being aligned with said opening for receiving a ground terminal for grounding the shell.

10. A shielded electrical connector assembly, comprising:

a dielectric housing having a plurality of terminal-receiving passages, with an opening in an outside wall of the housing communicating with one of the passages;

a plurality of terminals inserted into the passages, with one of the terminals being a ground terminal having an engaging portion aligned with said opening in the housing; and a conductive shell including a pair of shell halves substantially surrounding the dielectric housing, one of the shell halves including a pair of finger portions formed integrally with the shell extending through the opening in the housing for straddling and engaging the engaging portion of the ground terminal.

11. The shielded electrical connector assembly of claim 10 wherein said pair of finger portions have opposing, tapered edges to define a converging mouth for positively gripping the engaging portion of the terminal.

12. The shielded electrical connector assembly of claim 10 wherein said terminal-receiving passage has opposite ends, and the opening in the housing is located near one end of the passage.

13. The shielded electrical connector assembly of claim 10 wherein said housing has a forward mating end and rearward terminating end, and the opening in the housing is located intermediate the ends.

* * * * *